US010508881B2

(12) United States Patent
Peterson

(10) Patent No.: US 10,508,881 B2
(45) Date of Patent: Dec. 17, 2019

(54) MOUNT FOR HOLDING AND LOCKING A FIREARM

(71) Applicant: Donald J. Peterson, Fortville, IN (US)

(72) Inventor: Donald J. Peterson, Fortville, IN (US)

(73) Assignee: Donald J. Peterson, Fortville, IN (US)

( * ) Notice: Subject to any disclaimer, the term of this patent is extended or adjusted under 35 U.S.C. 154(b) by 0 days.

(21) Appl. No.: 16/273,673

(22) Filed: Feb. 12, 2019

(65) Prior Publication Data

US 2019/0178600 A1 Jun. 13, 2019

Related U.S. Application Data

(63) Continuation of application No. 15/782,096, filed on Oct. 12, 2017, now Pat. No. 10,203,176.

(51) Int. Cl.

| | |
|---|---|
| ***F16M 13/00*** | (2006.01) |
| ***F41A 23/18*** | (2006.01) |
| ***F41A 23/00*** | (2006.01) |
| ***F41A 17/44*** | (2006.01) |
| ***F41C 33/04*** | (2006.01) |

(52) U.S. Cl.

CPC ..... *F41A 23/18* (2013.01); *F41A 17/44* (2013.01); *F41A 23/005* (2013.01); *F41C 33/041* (2013.01)

(58) Field of Classification Search

CPC ..... F41A 23/18; F41A 23/005; F41A 9/61; F16M 13/02

USPC ..... 248/551; 89/37.01, 37.11, 37.04; 211/64; 42/94, 70.11, 1.02

See application file for complete search history.

(56) References Cited

U.S. PATENT DOCUMENTS

| | | | |
|---|---|---|---|
| 3,018,576 | A | 1/1962 | Riechers |
| 3,767,093 | A | 10/1973 | Pinkerton et al. |
| 3,802,612 | A | 4/1974 | Smith |
| 3,857,491 | A | 12/1974 | Townsend et al. |
| 4,030,221 | A | 6/1977 | Doobenen et al. |
| 4,364,499 | A | 12/1982 | McCue |
| 4,384,420 | A | 5/1983 | Von Muller |
| 4,532,729 | A | 8/1985 | Von Muller |
| 4,709,496 | A | 12/1987 | Johnson |
| 4,761,906 | A | 8/1988 | Guevara |
| 4,936,531 | A | 6/1990 | Bauser |
| 5,438,787 | A | 8/1995 | McMaster et al. |
| 5,621,996 | A | 4/1997 | Mowl, Jr. |
| 5,918,402 | A | 7/1999 | Weinraub |

(Continued)

FOREIGN PATENT DOCUMENTS

| | | |
|---|---|---|
| DE | 40 09 372 A1 | 10/1990 |
| WO | 1996/28704 | 9/1996 |
| WO | 2003/031900 | 4/2003 |

OTHER PUBLICATIONS

English Abstract of DE 40 0 32 A1. Translation obtained from Lexis-Nexis Total Patent on Jan. 2, 2018.

*Primary Examiner* — Todd M Epps

(74) *Attorney, Agent, or Firm* — Woodard, Emhardt, Henry, Reeves & Wagner, LLP

(57) ABSTRACT

A mount for holding and locking a firearm thereto. The mount includes an upwardly extending support mounted to a base, in turn, fixedly securable to a surface. The top end portion of the support is configured to extend into the magazine well of the firearm and has a mount pin slidably moveable into the firearm preventing removal of the firearm from the mount. A mechanism is provided for controllably moving the mount pin.

8 Claims, 5 Drawing Sheets

(56) References Cited

U.S. PATENT DOCUMENTS

| | | | | |
|---|---|---|---|---|
| 6,052,934 | A | 4/2000 | Carpenter | |
| 6,256,919 | B1 | 7/2001 | Brazeau | |
| 6,256,920 | B1 | 7/2001 | Olson | |
| 6,330,815 | B1 | 12/2001 | Duncan | |
| 6,694,659 | B2 | 2/2004 | Olsen | |
| 6,742,687 | B2 | 6/2004 | Morford | |
| 6,804,906 | B1 | 10/2004 | Olsen | |
| 6,880,282 | B1 | 4/2005 | Olsen | |
| 7,240,449 | B2 | 7/2007 | Clifton, Jr. | |
| 7,966,759 | B2 | 6/2011 | Bentley | |
| 8,347,539 | B2 | 1/2013 | Burns, III | |
| 8,540,086 | B2 | 9/2013 | Karst | |
| 8,590,203 | B1 | 11/2013 | McCarthy et al. | |
| 8,756,845 | B2 | 6/2014 | Harris | |
| 8,931,201 | B2 * | 1/2015 | Gianladis | F41A 23/18 42/94 |
| 8,950,596 | B2 * | 2/2015 | Arabian | B60R 7/14 211/64 |
| 9,234,715 | B2 * | 1/2016 | Cassady | F41A 9/61 |
| 10,203,176 | B1 * | 2/2019 | Peterson | F41A 23/005 |
| 2008/0120888 | A1 | 5/2008 | Matyko et al. | |
| 2010/0199540 | A1 | 8/2010 | Bentley | |
| 2014/0165439 | A1 | 6/2014 | Femandez et al. | |
| 2015/0241162 | A1 | 8/2015 | Geraghty et al. | |

* cited by examiner

MOUNT FOR HOLDING AND LOCKING A FIREARM

CROSS-REFERENCE TO RELATED APPLICATIONS

This application is a continuation of U.S. application Ser. No. 15/782,096, filed Oct. 12, 2017, which is hereby incorporated by reference in its entirety.

BACKGROUND OF THE INVENTION

Field of the Invention

The present invention is in the field of a mounting for securely holding and locking a firearm.

Description of the Prior Art

Gun racks with locking mechanisms are advocated by various safety organizations and are generally used with firearms to prevent the use of the firearm by an unauthorized user or to prevent the accidental discharge of the firearm. Other types of gunlocks serve similar functions but are primarily designed to prevent the discharge of the firearm. Gunlocks come in a number of forms, such as firearm encasement locks, trigger locks, cable locks, and chamber locks. Having a firearm readily assessable is of great importance for those involved in law enforcement or other security activities; however the firearm at the same time must be easily secured to protect against unauthorized use or theft.

Locking rifle racks come in various styles and configurations and serve the primary purpose of preventing the firearm from being handled by unauthorized persons. For example, racks are disclosed in the following patents: U.S. Pat. No. 4,364,499A issued to McCue, U.S. Pat. No. 8,540,086B2 issued to Karst, U.S. Pat. No. 4,936,531A issued to Bauser, U.S. Pat. No. 5,438,787A #1598707 issued to McMaster and Swanson, U.S. Pat. No. 6,330,815B1 issued to Duncan, U.S. Pat. No. 6,742,687B2 issued to Morford, U.S. Pat. No. 89,500,596B2 issued to Arabian and Dunn, U.S. Pat. No. 3,767,093A issued to Pinkerton and Duderstadt, U.S. Pat. No. 3,802,612A issued to Smith, and U.S. Pat. No. 3,857,491A issued to Townsend and Gillilan. These examples of prior art provide for a method of securing a firearm in some sort of a rack and protecting against unauthorized handling when the rack is locked. What these examples fail to provide is a secure method of securely holding a firearm in a readily accessible, yet either locked or unlocked position, or a means to display the firearm while securing it from unauthorized handling or theft.

Magazine well locks or breach locks art also come in a variety of designs and configurations but generally only protect against firearm loading or discharge. Some of these designs include U.S. Pat. No. 4,761,906A issued to Guevara, US20140165439A1 issued to Fernandez and Bentley, US20080120888A1 issued to Matyko and Akerman, U.S. Pat. No. 4,532,729A issued to Von Muller, U.S. Pat. No. 4,384,420A issued to Von Muller, U.S. Pat. No. 6,256,920B1 issued to Olason, DE4009372A1 issued to Rudolf and Stefan Czech, U.S. Pat. No. 3,018,576A issued to Riechers, U.S. Pat. No. 6,052,934A issued to Carpenter, WO1996028704A1 issued to Mauseth, U.S. Pat. No. 6,804,906B1 issued to Olsen, U.S. Pat. No. 6,694,659B2 issued to Olsen, U.S. Pat. No. 6,880,282B1 issued to Olsen, and U.S. Pat. No. 7,966,759B2 issued to Bentley. Of these examples of previous art, all are potentially capable of preventing loading and discharge of the firearm, although U.S. Pat. No. 6,256,919B1 issued to Brazeau provides a manner to protect the firearm from theft by means of an anchoring cable.

Magazine well blocks or breach blocks are intended to keep contaminants out of the magazine well or to hold open the bolt for safety purposes. The U.S. Pat. No. 8,590,203B1 issued to McCarthy, U.S. Pat. No. 4,709,496A issued to Johnson, U.S. Pat. No. 7,240,449B2 issued to Clifton and the US Patent Publication US20150241162A1 issued to Geraghty and Penney all provide means to protect the firearm against contaminants entering the magazine well or to hold the bolt in a non-firing position, but do not protect against theft.

A holding block to support a firearm in a vise or by other means is shown in U.S. Pat. No. 8,931,201 issued to Battenfeld Technologies and provides suitable means in which to hold a firearm during repair or maintenance but lacks the ability to secure the firearm in any other manner.

The invention disclosed herein relates to a mounting device that provides a means to securely store a firearm in an accessible location. The device allows for the release of the firearm into the operator's hands with the press of a button or the securing of the weapon with the engagement of the locking mechanism. This involves a substantial improvement over the existing use of locked gun racks, which can hold a weapon in a desired location and are lockable for security purposes but often require more than one hand to retrieve the weapon or to securely lock the weapon to the mount. In law enforcement or military applications it is desirable to have a weapon held securely within arm's reach yet also quickly locked or unlocked when necessary. With the firearm held securely the operator keeps his/her hands free to perform other tasks, like driving a vehicle, but still has the firearm readily available.

SUMMARY OF THE INVENTION

A mount for holding and locking a firearm with the firearm having a magazine well and a magazine locking catch extendable through a catch opening into the magazine well for locking a magazine in the well. The mount has a surface mountable base and a generally perpendicular extending support mounted to the base. The top portion support is configured to extend into the magazine well of the firearm and has the same general characteristics as the appropriate magazine for the subject weapon. A mount pin is slidably mounted within the top portion of the support and has a first position allowing unlimited movement of the magazine locking catch through the catch opening of the firearm, thus allowing the magazine latching catch to engage the mount in the same manner as it would engage a magazine. The second position of the mount pin engages the magazine locking catch of the firearm pushing the catch from the magazine well into the catch opening of the firearm magazine well and thus locking the mount to the weapon by preventing the removal of the firearm from the support. A mechanism moves the mount pin from the first position to the second position by the operator when a locking condition is desired.

It is an object of the present invention to provide a mount for releasably securing a firearm to a stationary base.

A further object of the present invention is to provide a firearm mount extendable into a firearm magazine well to releasably hold and, when desired, lock the firearm thereto.

An additional object of the present invention is to provide a secure means for holding a firearm that can be accessed only by an operator with an appropriate unlocking means.

A further object of the present invention is to provide a firearm mount that allows for easy release and immediate use of the firearm.

A further object of the present invention is to provide a firearm mount having a rapid release locking mechanism located on either side of a pedestal to facilitate ease of use of both right and left handed operators.

A further object of the present invention is to provide a firearm mount allowing for display of the firearm in an aesthetically pleasing manner while limiting unauthorized removal.

Related objects and advantageous of the present invention will be apparent from the following description.

DESCRIPTION OF THE PREFERRED EMBODIMENT

Figure 1A:
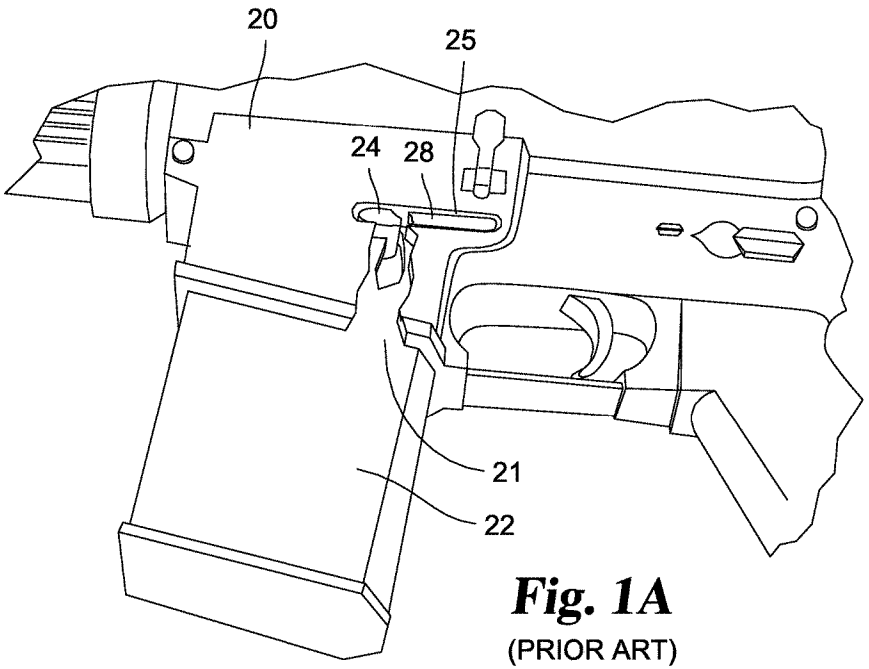
Fig. 1A (PRIOR ART)
FIG. 1(A) is a fragmentary perspective view of a prior art firearm with a magazine catch for holding the magazine thereto.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 1B:
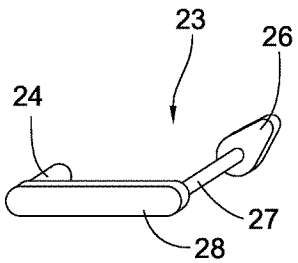
Fig. 1B (PRIOR ART)
FIG. 1(B) is a perspective view of the magazine catch assembly.

Referring now more particularly to FIG. 1A, there is shown a fragmented view of a conventional firearm 20 having a magazine well 21 for releasably holding a conventional magazine 22. A manual magazine catch assembly 23 (FIG. 1B) consists of a release button 26 attached to the threaded end of rod 27. An arm 28 is attached at the opposite end of rod 27 and has a nub or magazine pin 24 attached to arm 28 that projects inwardly toward the magazine 22. Arm 28 basically fills firearm opening 25 and may be moved inwardly and outwardly.

Assembly 23 is movably mounted to the firearm and is accessible from the opposite side of the firearm. Button 26 may be depressed from the right side of the firearm as viewed from the rear causing the magazine pin 24 to move outwardly through the left side of the firearm thereby releasing the magazine relative to the firearm. When button 26 is released, a spring (not shown) moves assembly 23 so pin 24 extends into the magazine well 21 and then into magazine 22 thereby holding the magazine securely to the firearm. The magazine 22 includes a hole into which the magazine pin 24 extends when the magazine is inserted into the magazine well. Such structure is well known in the industry.

Figure 2:
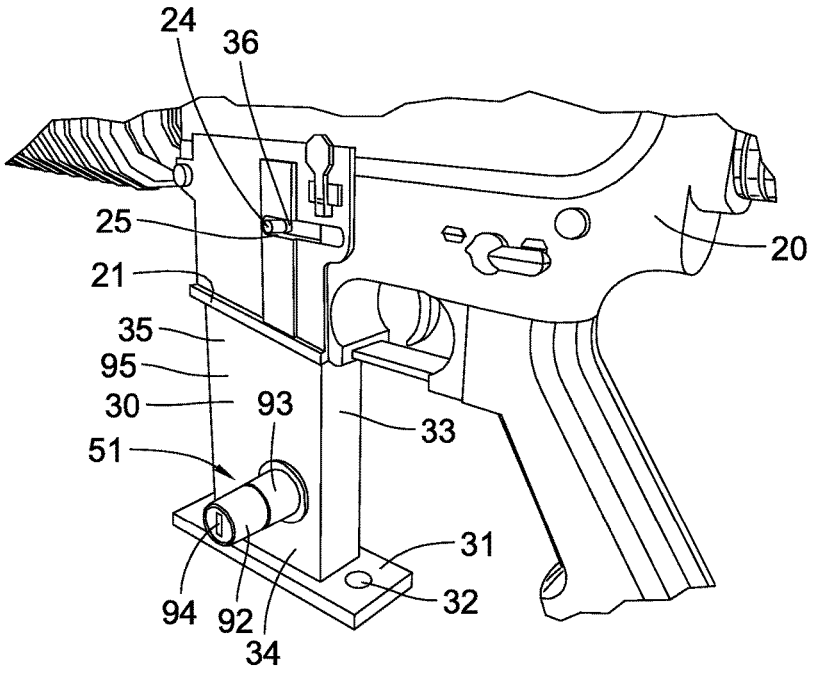
FIG. 2 is a perspective view showing the firearm mounted to a support.
Figure 3:
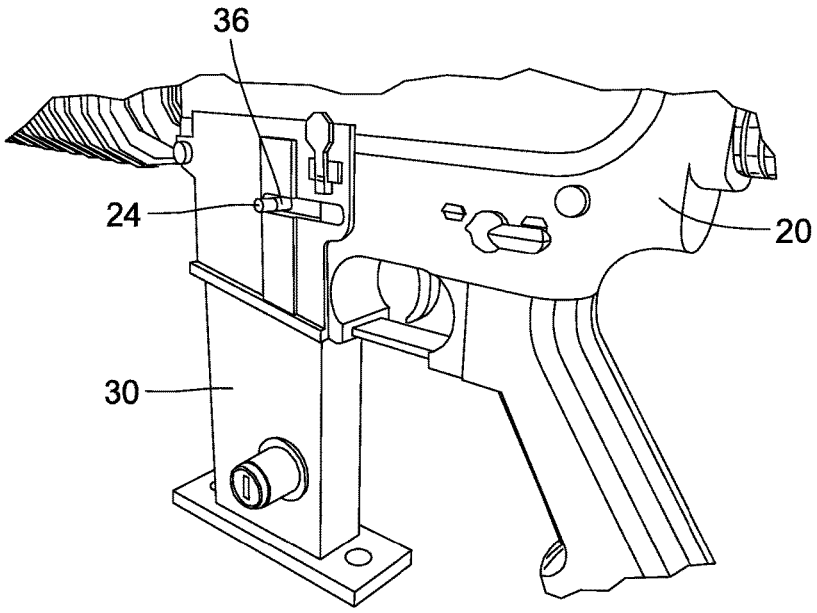
FIG. 3 is the same view as FIG. 2 only showing the mount pin projecting through the exterior wall of the magazine well of the firearm.

FIGS. 2 and 3 show the preferred embodiment of a firearm mount 30 extending into the magazine well 21 of firearm 20. The magazine pin 24 is shown FIGS. 2, 3, 4, and 5 whereas arm 28 has not been shown for the purpose of clarity in order to illustrate the positioning of the mounting pin 36 of the support 33. FIGS. 4-8 depict alternate mechanisms within mount 30 for controlling movement of the mounting pin 36.

Mount 30 includes a base or mounting plate 31 fixedly securable to a mounting surface. Fasteners holes 32 extend through plate 31 allowing conventional fasteners to secure base 31 to a suitable mounting surface, for example, the top of a desk, vehicle component, etc. An upwardly extending support 33 is mounted to and atop the base 31 with the bottom end portion 34 secured to the base whereas the opposite top end portion 35 of the support is removably extendable into the magazine well 21 of firearm 20. Top end 35 is configured and sized to extend into the magazine well and has a shape essentially identical to the top end of magazine 22. In order to mount the firearm to mount 30, magazine 22 is removed from the magazine well with the top end 35 of the mount then being extended into the magazine well. While one type of firearm is depicted in FIGS. 1-3, it is to be understood that the present invention applies to a variety of different firearms which use similar designs of detachable magazines. Thus, the top end 35 of support 33 is sized to fit the particular firearm to be mounted there atop.

Figure 4:
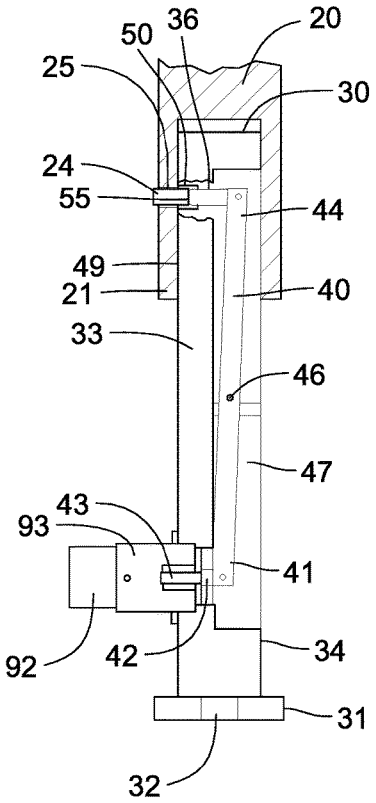
FIG. 4 is a schematic cross-sectional view of a first mechanism for securing the firearm to a mount of FIG. 2 with the mount pin being in a retracted and unlocked position.
Figure 5:
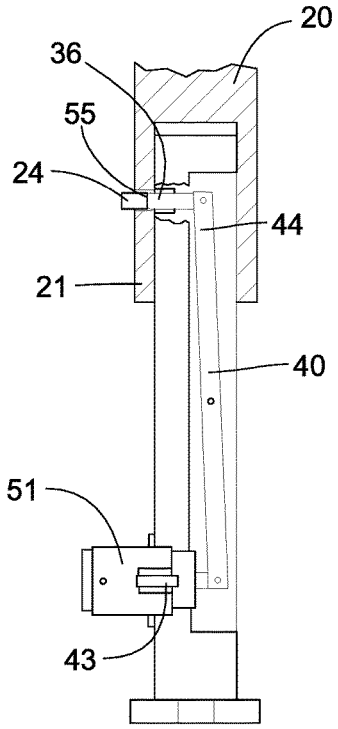
FIG. 5 is a the same view as FIG. 4 only showing the mount pin in the engaged position projecting through the exterior wall of the magazine well of the firearm.

A first version of the mechanism to move the mounting pin 36 of mount 30 is shown in FIGS. 4 and 5. The housing 47 of mount 30 is hollow with an upwardly extending member 40 having a bottom or proximal end 41 pivotally mounted to the distal end 42 of an extendable lock member 43. The opposite or top end portion 44 of member 40 is pivotally connected to mounting pin 36. Member 40 is pivotally mounted by pin 46 secured to the sidewall of the support housing 47. When member 43 is withdrawn or moved to the left as shown in FIG. 4, member 40 pivots in a clockwise direction pulling mounting pin 36 to the right and thus the distal end 55 of pin 36 does not extend outwardly of housing 47 allowing entrance of the magazine pin 24 into aperture 50 of support 33 and thus, the firearm is latched to the mount in the same manner as a magazine would be attached. When member 43 is extended to the right as shown in FIG. 5, member 40 pivots in a counterclockwise direction pushing mounting pin 36 to the left and thus the distal end 55 of pin 36 extends outwardly of support 33 and into the magazine catch opening 25 of the firearm thereby locking the firearm to the mount.

In FIG. 4, distal end 55 of pin 36 has a distal end outer surface that is withdrawn within support 33 past the vertical exterior side surface 49 of support 33 thereby allowing the magazine catch pin 24 to extend into aperture 50 of support 33. Thus, the magazine catch pin 24 functions in the same manner as it would to retain a magazine in the magazine well. The firearm mount combination is therefore in a latched but unlocked position and may only be removed when pin 24 is retracted by depressing button 26 on the firearm.

In order to secure the firearm to the mount and prevent the removal of the firearm, push button 92 is depressed causing lock member 42 to move to the right causing counterclockwise motion of member 40 with the top end 44 of member 40 pushing mount pin 36 outwardly through aperture 50 and into magazine catch opening 25 (FIG. 4) of the firearm sidewall preventing the firearm from being lifted or removed from the mount.

In the case of the mount shown in FIG. 2 for the mechanism shown in FIGS. 4 and 5, a push button lock assembly 51 is mounted to the outwardly facing vertical surface 95 of support 33 which is beneath the top end of the support and beneath firearm 20 mounted thereatop.

Push button assembly 51 is a commercially available lock having a push button cylinder 92 with a housing 93 fixed to support 33 and a push button cylinder 92 slidably mounted within housing 93. Depressing the cylinder forces lock member 43 in the direction as the pushing motion, causing the lock member 43 attached to cylinder 92 to pivot member 40 in a counterclockwise direction and locking mounting pin 36 in the outward position while positioned within the firearm thereby preventing removal of the firearm from the mount. To unlock push button 51, a key is inserted into the key hole 94 of cylinder 92 thereby releasing cylinder 92 relative to housing 93 and causing and allowing lock member 43 to be retracted thereby pulling the mounting pin 36 from the firearm and entirely back into the mount.

Releasing the push button allows cylinder 92 to move outwardly and member 40 rotates clockwise with the mount pin 36 moving to a second position (FIG. 4) entirely within the support allowing the firearm to be removed from the mount. In the event the assembly 51 is locked, then the mount pin 36 is locked in the second position, as in FIG. 5, and the firearm cannot be removed from the mount.

When the push button 92 is not depressed there is no restriction of movement limiting movement of the magazine pin 24 relative to mount 30 allowing pin 24 to engage aperture 50 and latching the weapon to the mount as depicted in FIG. 4.

Figure 6:
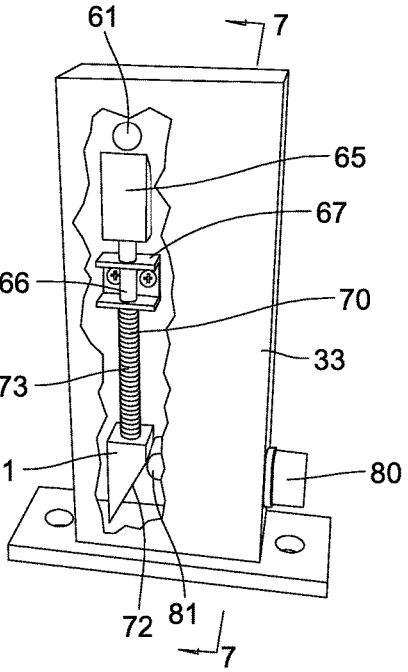
FIG. 6 is a cutaway perspective view of a second mechanism with a mount pin.
Figure 7:
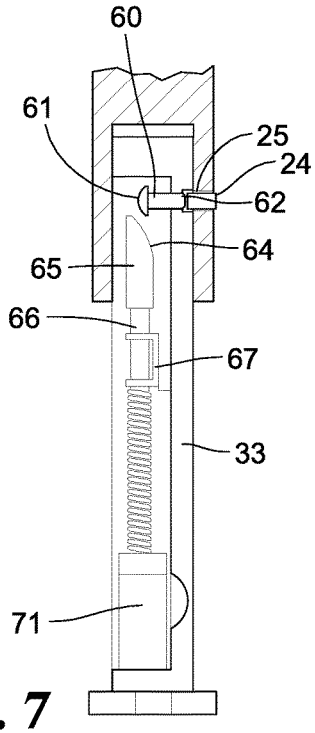
FIG. 7 is a cross-sectional view taken along the line 7-7 of FIG. 6 and viewed in the direction of the arrows illustrating the mount pin in the retracted and unlocked position.
Figure 8:
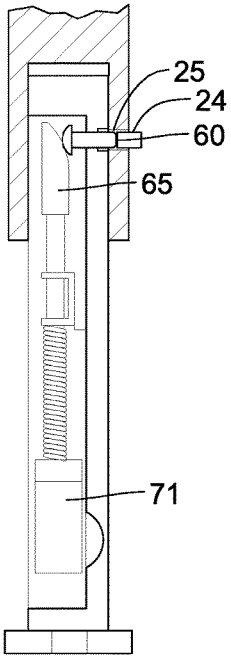
FIG. 8 is the same view as FIG. 7 only illustrating the mount pin in the engaged position projecting through the exterior wall of the magazine well of the firearm.

FIGS. 7 and 8 show respectively the unlocked condition and the locked condition of a second design of a similar mechanism housed within mount 30 in lieu of the mechanism depicted in FIGS. 4 and 5 for moving the mounting pin of the support 33 into opening 25 of the firearm 20. A cutaway view of the mechanism 70 housed within support 33 is shown in FIG. 6. Mounting pin 60 is slidably mounted to the sidewall of support 33 and includes an outwardly facing surface 62 to project outwardly from support 33 and into the catch opening 25 provided in the firearm 20. The interior end 61 of pin 60 has a rounded surface to slidably engage a wedge surface 64 formed on distal end 65 of stem 66 slidably mounted and extending through an alignment bracket 67 mounted in the interior of support 33. Stem 66 extends downwardly having its bottom end attached to a wedge shaped element 71 having a wedge surface 72. Stem 66 therefore has its opposite ends attached to a top wedge shaped element 65 and a bottom wedge shaped element 71. Stem 66 extends through a helical spring 73 positioned between bracket 67 and the top surface of wedge shaped element 71. The spring is operable to normally force element 71 downwardly thereby moving stem 66 downwardly along with the top wedge shaped element 65. A push button lock 80 is mounted to the wall of support 33 and has a rounded inwardly facing end 81 in contact with wedge surface 72 of element 71. By depressing button lock 80, end 81 is caused to move inwardly against wedge surface 72 forcing the wedge surface, stem and element 65 to move upwardly with wedge surface 64 thereby engaging end surface 61 of pin 60 to force the mount pin 60 outwardly from support 33 and into the magazine catch opening 25 in the sidewall of the firearm securing the firearm to support 33. Once the commercially available push button 80 is moved from the depressed position, spring 73 is operable to force stem 66 downwardly thereby allowing mount pin 60 to move inwardly disengaging the magazine catch opening 25 in the firearm 20. An auxiliary spring may be used to normally bias pin 60 to its retracted or unlocked position.

In both versions of the mount shown in FIGS. 4-5 and FIGS. 6-8, the mounting pins 36 and 60 are slidably mounted to the top portion of support 33 and have a position depicted in FIGS. 4 and 7 that allow movement of pin 24 through the catch opening 25 of the firearm and into aperture 50 thus allowing pin 24 to latch the firearm 20 to the mount 30. In both versions, aperture 50 of the support 30 is alignable with the catch opening 25 of the firearm. Further, the mounting pins 36 and 60 have a position to force pin 24 of the firearm outwardly, relative to mount 30, allowing mounting pin 36 and 60 to engage opening 25 in the firearm 20.

Figure 9:
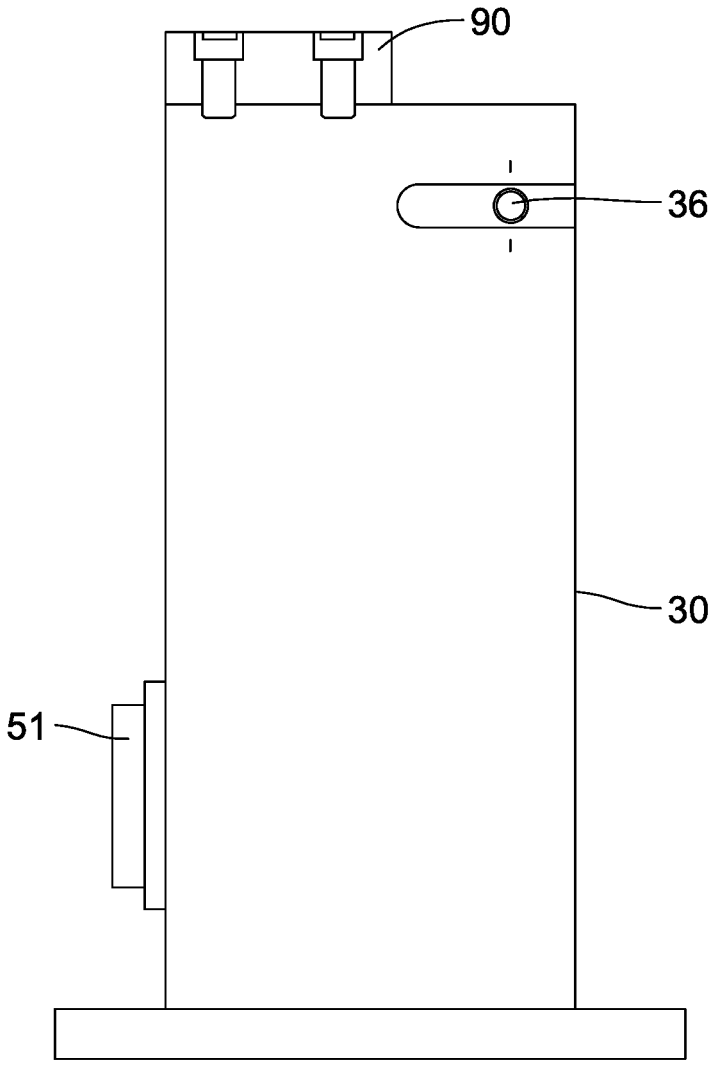
FIG. 9 is a side view of an optional bolt block device.

The firearm mounting device disclosed herein may be used within a magazine-fed firearm with a detachable magazine and a spring loaded catch engaging the exterior wall of the magazine and may be used to latch or securely hold the firearm to the mount once the magazine is removed from the firearm. The device securely holds the firearm with the ability to release the firearm with a push of the magazine release button. With an addition of an optional bolt block 90 (FIG. 9) mounted atop the mount 30 and extendable into the firearm chamber, the device prevents weapon discharge. Further, the firearm may be locked onto the mount thereby preventing the firearm from being disengaged from the device. The lower body of the mount fastens securely to the desired location, such as within a vehicle or any suitable location where the firearm needs to be stored securely yet readily available and securely locked in position when required.

In one embodiment, the locking cylinder is positioned perpendicular to the locking pin that holds the firearm in a fixed, and if desired locked, position utilizing a series of mechanical components in a cantilever or similar design to engage the locking pin when a plunger style cylinder lock is depressed. A key, fob, or alternate release mechanism is used to unlock or otherwise disengage the locking pin and allow the firearm to be separated from the mount. In a variant, the fastening or locking cylinder is positioned parallel to the locking pin utilizing a mechanical wedge design to engage the locking pin when a plunger style cylinder lock is depressed. A key, fob, or alternate release mechanism is provided to unlock or otherwise disengage the locking pin and allow the firearm to be separated from the mount. Support 33 (FIG. 2) has a vertically extending surface with the push button lock 93 located thereon allowing access below the firearm mounted atop the support.

The lower body of the mount has a plane mounting bracket for attachment to a surface with anti-tamper fasteners or any method to make removal difficult if not impossible without significant resources. Thus, various designs of the lower bracket allow for unique mounting applications, most noteworthy for use by law enforcement to mount a firearm to different makes or models of vehicles.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

What is claimed is:

1. A method for holding and locking a firearm, which has a magazine well and a magazine locking catch extendable through a magazine catch opening into said magazine well, to a device that has a top portion configured to conform to a shape of said magazine well and a slidable pin that aligns with said magazine catch opening, comprising the following steps:

inserting the device into the magazine well of the firearm; and allowing the magazine locking catch of the firearm to engage the device and secure the device in position while the slidable pin is in a first position allowing movement of the magazine locking catch through the magazine catch opening.

2. The method of claim 1 and further comprising:

moving the slidable pin to a second position so that the slidable pin pushes the magazine locking catch from the magazine well into the magazine catch opening to engage the magazine catch opening of the firearm.

3. The method of claim 2 and further comprising:

wherein the slidable pin is stationary in the second position so as to secure the device and the firearm to each other in a secured position.

4. The method of claim 3 and further comprising:

releasing the device and firearm from the secured position by returning the slidable pin to the first position.

5. The method of claim 4, wherein the device includes a mechanical locking assembly, and wherein the releasing step includes operating the mechanical locking assembly.

6. The method of claim 5, wherein the operating include inserting a key into the mechanical locking assembly.

7. The method of claim 2, wherein the device includes a mechanical locking assembly, and wherein the moving step includes operating the mechanical locking assembly.

8. The method of claim 7, wherein the operating includes pushing a button of the mechanical locking assembly.

* * * * *